US005647236A

United States Patent [19]

Tippins

[11] Patent Number: 5,647,236

[45] Date of Patent: Jul. 15, 1997

[54] METHOD OF ROLLING LIGHT GAUGE HOT MILL BAND ON A HOT REVERSING MILL

[75] Inventor: George W. Tippins, Pittsburgh, Pa.

[73] Assignee: Tippins Incorporated, Pittsburgh, Pa.

[21] Appl. No.: 371,137

[22] Filed: Jan. 11, 1995

[51] Int. Cl.[6] ..... B21B 1/34

[52] U.S. Cl. ..... 72/8.8; 72/229; 72/365.2

[58] Field of Search ..... 72/8.8, 11.5, 226, 72/229, 365.2, 366.2

[56] References Cited

U.S. PATENT DOCUMENTS

| | | | |
|---|---|---|---|
| 372,747 | 11/1887 | Everson | 72/229 |
| 1,964,503 | 6/1934 | Coryell | 72/229 |
| 2,025,002 | 12/1935 | McIlvried | 72/229 |
| 2,123,291 | 7/1938 | Smitmans | 72/202 |
| 3,331,232 | 7/1967 | King | 72/365 |
| 3,485,077 | 12/1969 | Wilson | 72/229 |
| 4,497,191 | 2/1985 | Langer et al. | 72/202 |
| 4,580,428 | 4/1986 | Brettbacher et al. | 72/226 |
| 4,745,556 | 5/1988 | Turley | 72/229 |
| 4,793,169 | 12/1988 | Ginzburg | 72/240 |
| 4,958,677 | 9/1990 | Kimura | 164/452 |
| 5,133,205 | 7/1992 | Rostik et al. | 72/200 |
| 5,140,837 | 8/1992 | Thomas et al. | 72/229 |
| 5,276,952 | 1/1994 | Thomas et al. | 29/527.7 |
| 5,437,089 | 8/1995 | Salganik et al. | 72/229 |

OTHER PUBLICATIONS

Sendzimir, Michael G., "Hot strip mills for thin for thin slab continuous casting systems" *Iron and Steel Engineer*, Oct. 1986, pp. 36–43.

Buch, E. et al., "Continuous thin slab casting–direct rolling. Why the planetary hot strip mill?", May 1987.

*Primary Examiner*—Lowell A. Larson
*Assistant Examiner*—Thomas C. Schoeffler
*Attorney, Agent, or Firm*—Webb Ziesenheim Bruening Logsdon Orkin & Hanson, P.C.

[57] ABSTRACT

The invention provides a method for rolling hot mill band on a hot reversing mill so as to achieve acceptable finishing temperatures for such a light gauge product. The invention also minimizes the threading of a light gauge product through the mill and decreases the likelihood of cobbles along the runout table.

20 Claims, 3 Drawing Sheets

METHOD OF ROLLING LIGHT GAUGE HOT MILL BAND ON A HOT REVERSING MILL

FIELD OF THE INVENTION

This invention relates to the rolling of hot mill band and more particularly to the rolling of light gauge hot mill band on a hot reversing mill having coiler furnaces on each side thereof.

DESCRIPTION OF THE PRIOR ART

Historically, there has always been a recognized distinction between hot mill band or strip and cold reduced flat rolled products which are produced from hot mill bands. Hot rolled finished flat products are generally divided into four major groups; namely, bar, plate, hot rolled strip and hot rolled sheet. Cold rolled products, which are all classified as finished, are divided into four groups; namely, bar, strip, sheet and black plate (a term used to identify thin sheet or strip used to produce tin plate). Hot mill bands are generally thicker than cold rolled products and because of the thermal decay through temperature loss associated with thinner gauges, hot rolled products are generally maintained at 0.080 inch and higher, particularly for wide hot mill band. In recent years, the market for hot mill band of lighter gauge has increased due in part to the recognition that many applications for sheet or strip simply do not require many of the properties such as surface or ductility associated with cold rolled products. Because of the substantial disparity in price between hot roll band and cold rolled products, increased pressure is being placed on manufacturers of hot mill band to produce lighter and lighter thicknesses.

One such application is the substitution of light gauge steel girders for wooden 2×4s and the like in home construction. Specifically, light gauge hot band on the order of 0.040 inch can be used after galvanizing in home construction to replace many of the wooden structural members which are becoming more expensive as the result of the depletion of our wood supply.

The last hot rolling operation in the last finishing stand should be conducted above the upper critical temperature (Ar3). This permits the rolled steel to pass through a phase transformation after all hot work is finished to produce a uniformly fine equiaxed ferritic grain throughout all portions of the steel. For low carbon steels, a finishing temperature above 1550° F. is normally required. Many conventional hot strip mills are unable to meet the finishing temperatures at these thin gauges.

In addition to temperature constraints, it becomes increasingly difficult to thread strip through the mill as it gets thinner thereby slowing down production. Also, at the high operating speeds for light gauges, it becomes increasingly difficult to maintain the strip on the runout table following the last finishing pass and cobbles are of increasing concern as the thickness of the final hot mill band is decreased.

SUMMARY OF THE INVENTION

My invention provides a method for rolling hot mill band on a hot reversing mill so as to achieve acceptable finishing temperatures for such a light gauge product. My invention also minimizes the threading of a light gauge product through the mill and decreases the likelihood of cobbles along the runout table.

My invention utilizes a hot reversing mill having one or more four high mill stands and a coiler furnace and drum on each side thereof. In a preferred embodiment, two four high mill stands are employed.

The light gauge hot mill band of a thickness down to 0.040 inch is produced by passing a slab back and forth through the mill to form an intermediate product having a thickness capable of being coiled. Thereafter, the intermediate product is passed back and forth between the drums of the coiler furnaces and through the mill. During the next to the last or penultimate pass, the trailing end of the intermediate product is stopped before it reaches the mill. On the final pass through the mill stand or stands, the intermediate product is rolled to the final gauge and the trailing end which did not receive a final reduction is removed.

In a preferred form of the invention, 0.040 inch gauge hot mill band is produced at acceptable finishing temperatures and the rolling of the intermediate product is stopped in its penultimate pass at pinch rolls positioned between the coiler furnaces and the mill. After the final pass, the unreduced trailing section may be removed as well as the reduced end portion outside of the coiler furnace.

DESCRIPTION OF THE PREFERRED EMBODIMENTS

Figure 1:
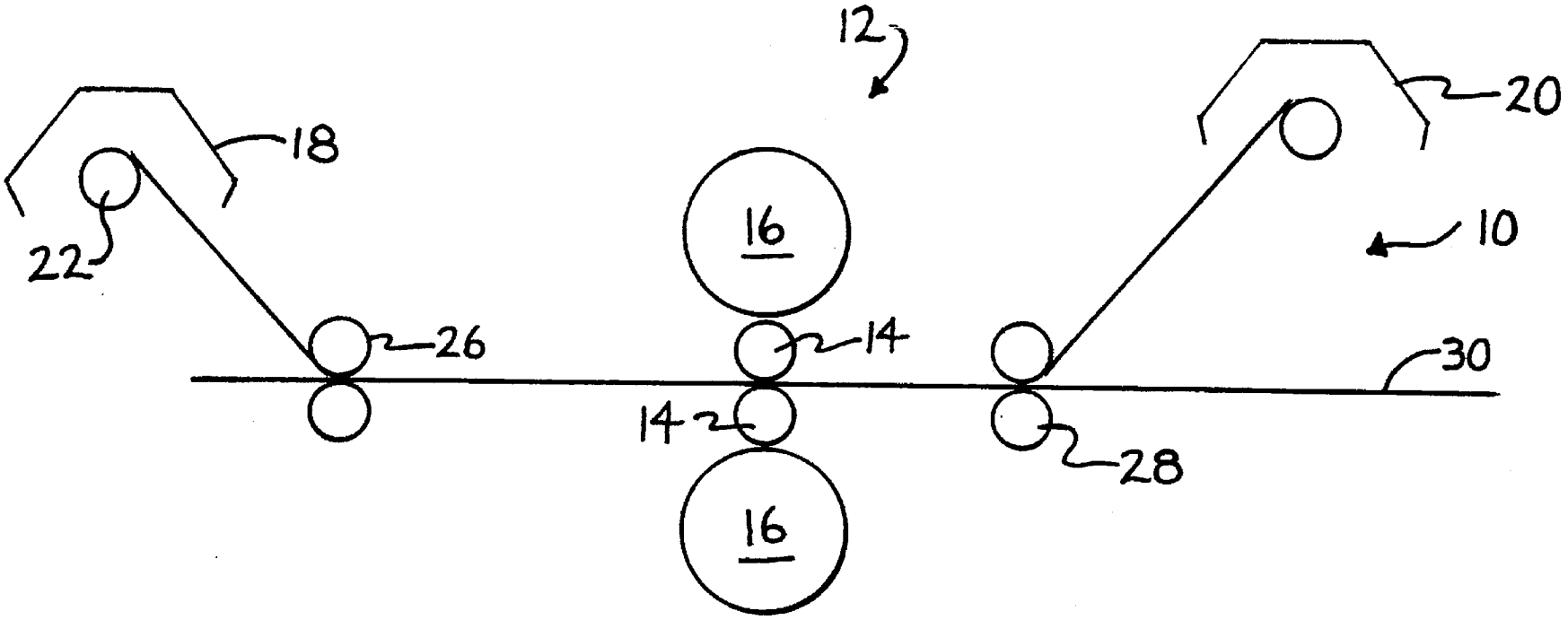
FIG. 1 is a schematic showing the method being carried out on a single stand hot reversing mill.

The general arrangement of a single stand mill 10 is illustrated in FIG. 1. The mill 10 includes a four high hot reversing mill 12 having a pair of work rolls 14 and a pair of backup rolls 16. A coiler furnace 18 is positioned upstream of the mill 12 and a coiler furnace 20 is positioned downstream thereof. The upstream coiler furnace 18 includes a drum 22 about which the product being rolled is coiled once it has been reduced to a thickness capable of being coiled. In a similar manner, downstream coiler furnace 20 includes drum 24. A pair of pinch rolls 26 is positioned between the coiler furnace 18 and the mill 12 and a second pair of pinch rolls 28 is positioned between the mill 12 and the coiler furnace 20. The mill 12 operates along the pass line 30 to reduce a slab (not shown) to an intermediate product 32 and finally to a light gauge hot mill band (not shown).

Figure 2:
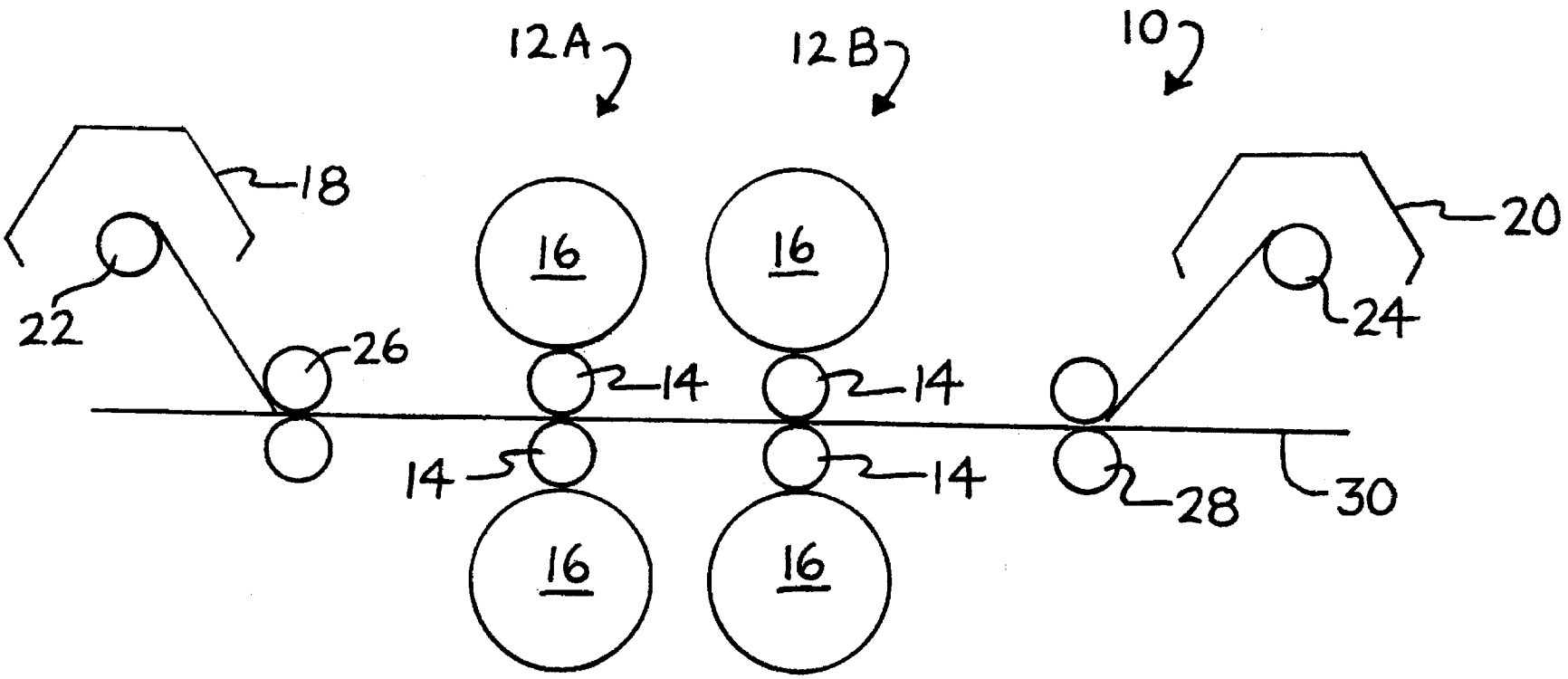
FIG. 2 is a schematic showing the method being carried out on a twin stand hot reversing mill.

The arrangement of FIG. 2 differs only in that the hot reversing mill includes a pair of roll stands **12*a* and 12*b*. The remaining mill equipment shown in FIG. 1 is also present in FIG. 2**.

While any slab thickness can be employed, my method finds particular applicability to an intermediate thickness slab having a thickness of three to six inches. Such a slab can be produced on a continuous caster and hot strip integrated line as illustrated in U.S. Pat. No. 5,276,952. Such a slab heated to the appropriate rolling temperature is flat passed back and forth through the mill 12 or **12*a* and 12*b*** until it reaches a thickness capable of being coiled. This thickness is normally on the order of one inch. This is normally accomplished in three passes through a single stand mill and four passes in a twin stand mill. Therefore, in a single stand mill, coiling first takes place on the downstream coiler whereas in a twin stand mill, coiling first takes place on the upstream coiler.

The intermediate product is passed back and forth through the single stand mill or the twin stand mill and between the drums in the respective coiler furnaces. This continues until the penultimate pass. On the penultimate pass, the rolling is stopped as the trailing end of the coil leaves the coiler drum and is in the area of the pair of pinch rolls associated with the coiler drum.

Figure 3:
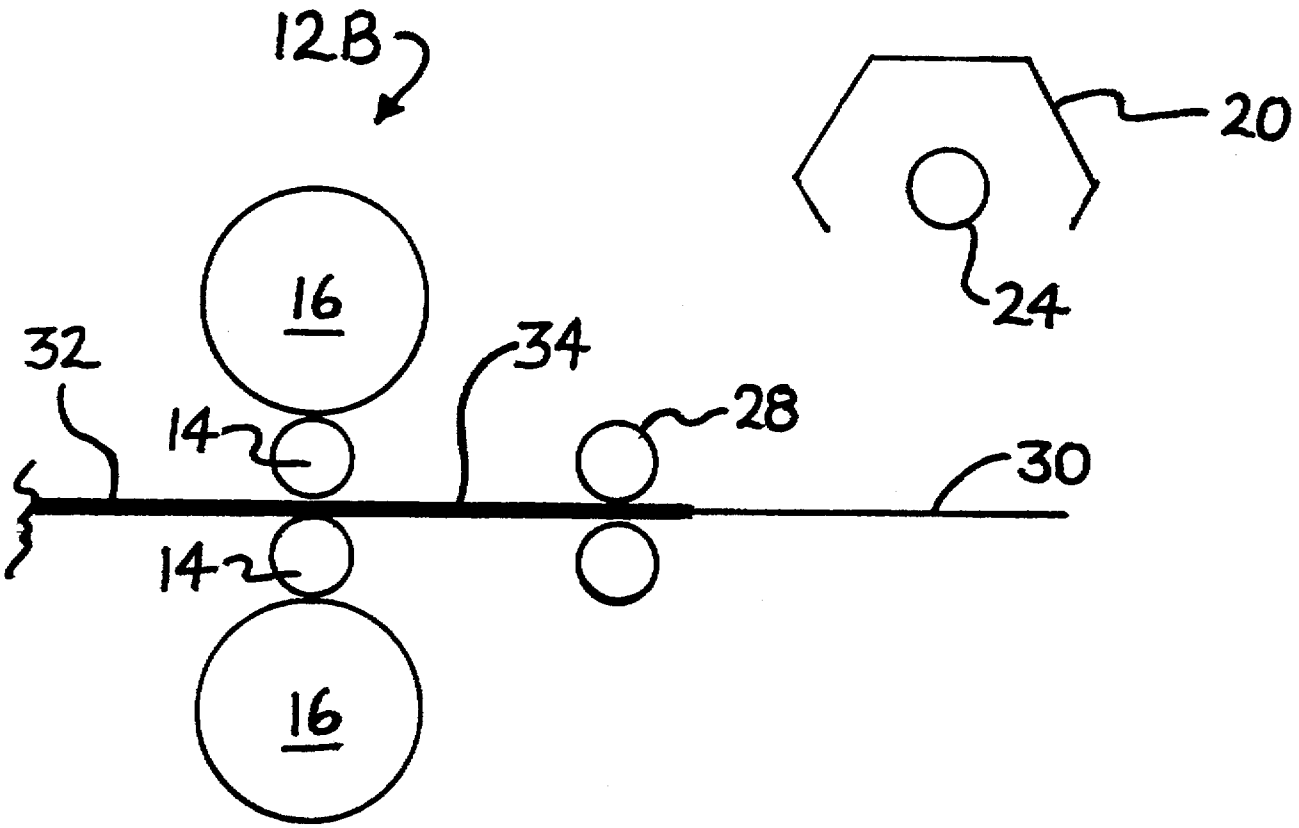
FIG. 3 is a schematic showing the trailing end of the hot mill band in its final position on the penultimate pass.

This trailing end illustrated at 34 in FIG. 3 is normally the head end of the slab as the slab first approaches the hot reversing mill. Because this trailing end has had the most exposure to ambient temperature as the slab is reduced in the hot reversing mill, it normally loses the most heat and therefore has the greatest tendency to be below an acceptable finishing temperature. To protect against this, the trailing end is normally deemed to extend from the pinch rolls through the mill and to the other coiling furnace. After the penultimate pass, the mill or mills are reversed and the roll gaps are set to meet the final product thickness after the trailing end has passed through the mill stand or stands.

Because the trailing end is not passed through the mill stand or stands, it is not necessary to re-thread the intermediate product which becomes increasingly difficult at lighter gauges. Further, to the extent the coil end is crimped onto the drum, the pinch rolls can be used to flatten out any crimped portion. In addition, because the trailing end is thicker than the balance of the hot mill band, the hot mill band is stabilized as it passes along the runout table and through the normal cooling sprays prior to being coiled. This substantially lessens the likelihood of cobbles. An additional benefit of the present invention relates to the improved coiling on the downstream downcoiler of the thin gauge coil. It is often difficult to maintain the roundness of light or thin gauge coils, as such a coil tends to collapse on itself. The light gauge strip does not always form an acceptably stable core for the coil to be formed upon, and the resulting coil becomes oblong or out of round. The present invention maintains a thicker trailing end on the penultimate pass which will form a stable core on the downcoiler better maintaining a round coil even at the thin 0.040 gauge and preventing collapse. Ultimately, the trailing end is eliminated, such as by shearing, so that the hot mill band is of the uniform desired gauge.

Example I

A computer simulation of rolling schedules was created for three existing mills and a two stand reversing mill of the type disclosed herein. Those rolling schedules are as follows:

TABLE I 25.045 tons 1002. PIW
Rolling Schedule HSM - 50.00–10.0000/.8800
Roughing Mill

| Mill Stand Name | Gauge in. | % Red | Draft in. | Bite Angle Deg. | Length ft. | Elapsed Time sec. | Entry Temperature Deg. F. | Exit Temperature Deg. F. | Roll Force lb × 10**6 | Torque lb-ft × 10**6 | Horse Power | Load Ratio | RMS Time sec. |
|---|---|---|---|---|---|---|---|---|---|---|---|---|---|
| Fce: | 10.0000 | .0 | .0000 | .00 | 29.50 | .00 | 2300.00 | 2300.00 | .0000 | .0000 | 0. | .0000 | .00 |
| RR1: | 7.8000 | 22.0 | 2.2000 | 17.99 | 37.82 | 12.56 | 2271.93 | 2264.26 | 3.3124 | 2.4384 | 11823. | 1.3055 | 12.89 |
| RR2: | 5.6000 | 28.2 | 2.2000 | 17.99 | 52.68 | 23.53 | 2252.67 | 2253.87 | 3.3767 | 2.3249 | 19915. | 1.2447 | 9.24 |
| RR3: | 3.4000 | 39.3 | 2.2000 | 17.99 | 86.76 | 35.96 | 2238.69 | 2234.97 | 3.4935 | 2.2014 | 24906. | 1.5566 | 18.02 |
| RR4: | 1.6000 | 52.9 | 1.8000 | 16.26 | 184.38 | 52.73 | 2206.13 | 2213.99 | 4.0747 | 2.1651 | 32893. | 2.0558 | 49.74 |
| RR5: | .8800 | 45.0 | .7200 | 10.26 | 335.23 | 74.13 | 2132.56 | 2137.41 | 3.9463 | 1.3070 | 19856. | 1.2410 | 32.96 |
| CF1: | .4400 | 50.0 | .4400 | 10.46 | 670.45 | 177.00 | 1629.48 | 1633.30 | 4.8305 | .9554 | 4767. | .4767 | 40.23 |
| CF2: | .2420 | 45.0 | .1980 | 7.01 | 1219.01 | 177.00 | 1612.55 | 1613.90 | 4.5881 | .5977 | 5423. | .5423 | 52.05 |
| CF3: | .1452 | 40.0 | .0968 | 4.83 | 2031.68 | 177.00 | 1593.98 | 1591.03 | 4.5277 | .4045 | 5949. | .5949 | 62.64 |
| CF4: | .0944 | 35.0 | .0508 | 3.52 | 3125.00 | 177.00 | 1572.00 | 1565.99 | 4.3453 | .2665 | 6084. | .6084 | 65.53 |
| CF5: | .0661 | 30.0 | .0283 | 2.62 | 4462.94 | 177.00 | 1548.77 | 1542.50 | 4.2987 | .1831 | 5969. | .5969 | 63.86 |
| CF6: | .0473 | 28.4 | .0188 | 2.10 | 6236.79 | 177.00 | 1527.32 | 1523.99 | 5.4861 | .1718 | 7549. | .7549 | 100.88 |
| CF7: | .0400 | 15.4 | .0073 | 1.31 | 7375.00 | 177.00 | 1510.19 | 1496.23 | 3.6478 | .0626 | 3251. | .4644 | 38.18 |

| | | |
|---|---|---|
| Distance/Length Ratio: | .5000 | |
| Continuous Finisher RMS Production: | 509.400 | TPH |
| Continuous Finisher Peak Production: | 509.400 | TPH |
| Final Body Temperature at TS: | 1496.23 | Deg. F. |
| Distance/Length Ratio: | .5000 | |
| Roughing Mill RMS Production: | 733.790 | TPH |
| Roughing Mill Peak Production: | 1216.280 | TPH |

TABLE II

RR + CBox + 7CF
25.045 tons 1002. PIW
Rolling Schedule HSM - 50.00–10.0000/.8800
Roughing Mill

| Mill Stand Name | Gauge in. | % Red | Draft in. | Bite Angle Deg. | Length ft. | Elapsed Time sec. | Entry Temperature Deg. F. | Exit Temperature Deg. F. | Roll Force lb × 10**6 | Torque lb-ft × 10**6 | Horse Power | Load Ratio | RMS Time sec. |
|---|---|---|---|---|---|---|---|---|---|---|---|---|---|
| Fce: | 10.0000 | .0 | .0000 | .00 | 29.50 | .00 | 2300.00 | 2300.00 | .0000 | .0000 | 0. | .0000 | .00 |
| RR1: | 7.8000 | 22.0 | 2.2000 | 17.99 | 37.82 | 12.56 | 2271.93 | 2264.26 | 3.3124 | 2.4384 | 11823. | 1.3055 | 12.89 |
| RR2: | 5.6000 | 28.2 | 2.2000 | 17.99 | 52.68 | 23.53 | 2252.67 | 2253.87 | 3.3767 | 2.3249 | 19915. | 1.2447 | 9.24 |
| RR3: | 3.4000 | 39.3 | 2.2000 | 17.99 | 86.76 | 35.96 | 2238.69 | 2234.97 | 3.4935 | 2.2014 | 24906. | 1.5566 | 10.02 |
| RR4: | 1.6000 | 52.9 | 1.8000 | 16.26 | 184.38 | 52.73 | 2206.13 | 2213.99 | 4.0747 | 2.1651 | 32893. | 2.0558 | 49.74 |
| RR5: | .8800 | 45.0 | .7200 | 10.26 | 335.23* | 146.64 | 2015.43 | 2023.95 | 4.6220 | 1.5308 | 23257. | 1.4545 | 198.39 |
| CF1: | .4400 | 50.0 | .4400 | 10.46 | 670.45 | 170.19 | 1691.26 | 1592.72 | 4.0045 | .9892 | 5430. | .5430 | 50.18 |
| CF2: | .2420 | 45.0 | .1980 | 7.01 | 1219.01 | 170.19 | 1573.52 | 1574.98 | 4.7494 | .6180 | 61.68. | .6168 | 64.75 |
| CF3: | .1452 | 40.0 | .0968 | 4.83 | 2031.68 | 170.19 | 1556.83 | 1557.03 | 4.6723 | .4167 | 6741. | .6741 | 77.33 |
| CF4: | .0944 | 35.0 | .0508 | 3.52 | 3125.00 | 170.19 | 1540.61 | 1539.29 | 4.4609 | .2730 | 6855. | .6855 | 79.97 |
| CF5: | .0661 | 30.0 | .0283 | 2.62 | 4462.94 | 170.19 | 1524.35 | 1521.54 | 4.3966 | .1867 | 6696. | .6696 | 76.31 |
| CF6: | .0473 | 28.4 | .0188 | 2.10 | 6236.79 | 170.19 | 1507.90 | 1507.26 | 5.5999 | .1748 | 8446. | .8446 | 121.40 |
| CF7: | .0400 | 15.4 | .0073 | 1.31 | 7375.00 | 170.19 | 1494.56 | 1482.42 | 3.7178 | .0635 | 3630. | .5185 | 45.76 |

| | | |
|---|---|---|
| Distance/Length Ratio: | .5000 | |
| Continuous Finisher RMS Production: | 514.656 | TPH |
| Continuous Finisher Peak Production: | 514.656 | TPH |
| Coil Box Diameter: | 56.00 | in. |
| Coil Box Transfer time: | 5.00 | sec. |
| Final Body Temperature at TS: | 1482.42 | Deg. F. |
| Distance/Length Ratio: | .5000 | |
| Roughing Mill RMS Production: | 312.762 | TPH |
| Roughing Mill Peak Production: | 594.608 | TPH |

TABLE III 24.961 tons 998. PIW
Rolling Schedule HSM - 50.00–2.0000/.0400
Continuous Finishing Mill

| Mill Stand Name | Gauge in. | % Red | Draft in. | Bite Angle Deg. | Length ft. | Elapsed Time sec. | Entry Temperature Deg. F. | Exit Temperature Deg. F. | Roll Force lb × 10**6 | Torque lt-ft × 10**6 | Horse Power | Load Ratio | RMS Time sec. |
|---|---|---|---|---|---|---|---|---|---|---|---|---|---|
| Fce: | 2.0000 | .0 | .0000 | .00 | 147.00 | .00 | 2000.00 | 2000.00 | .0000 | .0000 | 0. | .0000 | .00 |
| CF1: | 1.0000 | 50.0 | 1.0000 | 15.22 | 294.00 | 169.62 | 1830.02 | 1716.96 | 4.4149 | 1.3792 | 3097. | .6788 | 78.15 |
| CF2: | .5224 | 47.8 | .4776 | 10.50 | 562.79 | 169.62 | 1692.47 | 1691.64 | 4.5797 | .9808 | 4216. | .7195 | 87.80 |
| CF3: | .2873 | 45.0 | .2351 | 7.36 | 1023.32 | 169.62 | 1668.47 | 1569.56 | 5.0657 | .7476 | 5844. | .8073 | 110.54 |
| CF4: | .1724 | 40.0 | .1149 | 5.24 | 1705.34 | 169.62 | 1551.93 | 1552.47 | 4.5899 | .4532 | 6118. | .6320 | 67.74 |
| CF5: | .1120 | 35.0 | .0604 | 3.83 | 2625.00 | 169.62 | 1536.44 | 1535.36 | 4.2678 | .2908 | 6155. | .6155 | 64.26 |
| CF6: | .0784 | 30.0 | .0336 | 2.86 | 3750.00 | 169.62 | 1520.72 | 1517.86 | 4.0863 | .1959 | 5922. | .5922 | 59.48 |
| CF7: | .0588 | 25.0 | .0196 | 2.18 | 5000.00 | 169.62 | 1504.47 | 1499.66 | 3.9433 | .1336 | 5387. | .5387 | 49.23 |
| CF8: | .0471 | 19.9 | .0117 | 1.72 | 6242.04 | 169.62 | 1487.43 | 1479.83 | 3.4880 | .0830 | 4337. | .4337 | 31.90 |
| CF9: | .0400 | 15.1 | .0071 | 1.34 | 7350.00 | 169.62 | 1468.72 | 1458.08 | 3.1682 | .0534 | 3286. | .4695 | 37.39 |

| | | |
|---|---|---|
| Distance/Length Ratio: | .5000 | |
| Continuous Finisher RMS Production: | 529.776 | TPH |
| Continuous Finisher Peak Production: | 529.776 | TPH |
| Final Body Temperature at TS: | 1458.08 | Deg. F. |

TABLE IV 23.995 tons 1000. PIW
Rolling Schedule HSM - 48.00–5.0000/.0400
Tandem Reversing Mill

| Pass No. | Mill Stand Name | Gauge in. | % Red | Draft in. | Bite Angle Deg. | Length ft. | Elapsed Time sec. | Entry Temperature Deg. F. | Exit Temperature Deg. F. | Roll Force lb × 10**6 | Torque lb-ft × 10**6 | Horse Power | Load Ratio | RMS Time sec. |
|---|---|---|---|---|---|---|---|---|---|---|---|---|---|---|
| 0 | FCE: | 5.0008 | .0 | .000 | .00 | 58.9 | .00 | 2300.00 | 2300.00 | .0000 | .0000 | 0. | .0000 | .00 |
| 1 | TF1: | 3.4500 | 31.0 | 1.550 | 17.91 | 85.3 | 10.51 | 2249.34 | 2240.36 | 2.7082 | 1.1182 | 12376. | 1.9007 | 37.98 |
| 1 | TF2: | 2.1000 | 39.1 | 1.350 | 16.70 | 140.2 | 16.33 | 2236.82 | 2243.97 | 3.1090 | 1.1617 | 21122. | 1.9746 | 40.99 |
| 2 | TF2: | 1.1000 | 47.6 | 1.000 | 14.36 | 267.6 | 48.69 | 2172.39 | 2161.57 | 3.6238 | 1.1964 | 20394. | 2.0335 | 133.84 |
| 2 | TF1: | .5500 | 50.0 | .550 | 10.64 | 535.3 | 52.89 | 2144.28 | 2162.28 | 3.4926 | .8491 | 28947. | 2.0676 | 128.83 |
| 3 | TF1: | .2790 | 49.3 | .271 | 7.46 | 1055.2 | 130.30 | 2114.68 | 2061.62 | 3.6807 | .6192 | 14002. | 1.0525 | 85.74 |
| 3 | TF2: | .1388 | 50.3 | .140 | 5.37 | 2121.0 | 134.20 | 2046.47 | 2066.54 | 3.7064 | .4361 | 19823. | 1.4159 | 150.10 |
| 4 | TF2: | .0860 | 38.0 | 0.53 | 3.29 | 3423.3 | 267.44 | 1986.75 | 1877.24 | 3.697 | .2526 | 10013. | .7152 | 68.16 |
| 4 | TF1: | .0600 | 30.2 | .026 | 2.31 | 4906.7 | 270.96 | 1785.94 | 1793.27 | 3.6943 | .1628 | 9252. | .6608 | 57.34 |
| 5 | TF1: | .0270 | 21.7 | .013 | 1.63 | 6263.8 | 449.61 | 1728.29 | 1719.89 | 3.5552 | .0981 | 4744. | .3388 | 20.51 |
| 5 | TF2: | .0400 | 14.9 | .007 | 1.20 | 7360.0 | 449.61 | 1696.77 | 1680.75 | 3.1830 | .0570 | 3239. | .2313 | 9.45 |

| | | |
|---|---|---|
| Distance/Length Ratio: | .5000 | |
| Reversing Tandem Mill RMS Production: | 192.12 | TPH |
| Reversing Tandem Mill Peak Production: | 192.12 | TPH |
| Coiling Begins at Pass Number: | 2 | *TF1* |
| Tandem Passes begin at Pass Number: | 1 | *TF1* |
| Distance Between CFce #1 and Mill: | 30.00 | ft. |
| Distance Between Mill and CFce #2: | 30.00 | ft. |
| Coiling Furnace Diameter: | 54.00 | in. |
| Coiling Furnace Temperature: | 1750.00 | Deg. F. |
| Acceleration/Deceleration Rate: | 250.00 | FPM/sec |
| FInal Body Temperature at TS: | 1680.75 | Deg. F. |

The results are summarized in Table V which gives the mill design description and strip exit temperatures for the four mills shown in rolling schedule Tables I–IV. It will be noted that only the two stand reversing mill is capable of producing a 0.040 inch thick hot mill band at a finishing temperature which will produce a uniformly fine equiaxed ferritic grain throughout all portions of the steel.

TABLE V

Summary - Comparison of Hot Strip Mills

| Mill Design | Description | Strip Exit Temperature |
|---|---|---|
| (1) Conventional Hot Strip Mill Rolling 10" thick slab × 50" wide to .040" thick sheet | Reversing Roughing Mill and Seven Continuous Finishing Stands Finishing Speed 3000 FPM | 1492° F. (Too cold) |
| (2) Conventional Hot Strip Mill Rolling 10" thick slab × 50" wide to .040" thick sheet | Reversing Rougher & Coilbox and Seven Continuous Finishing Stands Finishing Speed 3000 FPM | 1482° F. (Too cold) |
| (3) Thin Cast Slab with Tunnel Reheating Furnace Rolling 2" thick slab × 50" wide to .040" thick sheet | Nine Stand Continuous Finishing Stands Finishing Speed 3000 FPM | 1458° F. (Too cold) |
| (4) Tippins TSP II Process Two Stand Reversing Mill with Vertical Edging Mill Between stands. Rolling 5" thick slab to .040" thick sheet | Two Stand Reversing Mill | 1680° F. (O.K.) |

Example 2

The following Table VI illustrates the temperature profiles after each pass in a single stand hot reversing mill in which a 59.06 inch wide, 4.92 inch thick slab is reduced to a finished thickness of 0.0787 inch.

TABLE VI

Reductions and Temperatures for Reducing a 59.06 Inch × 4.92 Inch Slab to a Hot Mill Band of .0787 Inch

| | Temperature | | | | Thickness |
|---|---|---|---|---|---|
| | Before Pass | | After Pass | | After |
| Pass No. | Tail | Head | Tail | Head | Pass |
| 1 | 2225 | 2239 | 2219 | 2223 | 3.34 |
| 2 | 2220 | 2193 | 2212 | 2182 | 1.968 |
| 3 | 2090 | 2182 | 2073 | 2160 | 1.000* |
| 4 | 2074 | 2042 | 2056 | 2022 | .470 |
| 5 | 1907 | 2009 | 1918 | 2014 | .2709 |
| 6 | 1869 | 1829 | 1871 | 1829 | .1760 |
| 7 | 1711 | 1769 | 1760 | 1760 | .1232 |
| 8 | 1624 | 1608 | 1638 | 1622 | .0925 |
| 9 | 1590 | 1534 | 1591 | 1510/ 1580** | .0787 |

*coiled at 1 inch
**1580° F. finishing temperature at head position discarding trailing end.

The removal of the trailing end extending to the coiler furnace resulted in a 2.2% yield loss for the coil. The finishing temperature of 1580° F. for this product was more than adequate to achieve the desired metallurgical properties.

Having thus described the invention in the detail and particularity required by the Patent Laws, what is desired protected by Letters Patent is set forth in the following claims.

I claim:

1. In a method of rolling light gauge hot mill band of a given thickness from a slab on a hot reversing mill having a coiler furnace and drum on each side thereof by passing said slab back and forth through said mill to an intermediate product having a thickness capable of being coiled and thereafter through said mill between said drums, the improvement comprising stopping during a penultimate pass a trailing end of the intermediate product before it reaches said mill and thereafter final passing said intermediate product through said mill and discarding said trailing end to form said hot mill band.

2. A method of rolling light gauge hot mill band of a given thickness from a slab on a hot reversing mill having a coiler furnace and drum upstream and downstream of said mill comprising in sequence:

a. passing said slab back and forth through said mill to form an intermediate product having a thickness capable of being coiled;

b. coiling said intermediate product on one of said upstream or downstream drums;

c. passing said intermediate product back and forth through said mill between said drums and onto one of said drums at a thickness greater than said given thickness;

d. decoiling said intermediate product and passing it through said mill onto a coiler in a penultimate pass while stopping said hot mill band in said mill so as to leave a trailing end at least some of which has not been further reduced;

e. decoiling said intermediate product and passing it through said mill in a final pass to said given thickness and at a desired finishing temperature; and f. removing said trailing end to form a hot mill band of said given thickness.

3. The method of claim 2, wherein said trailing end represents no more than 2.2% of said hot mill band.

4. The method of claim 2, wherein said hot reversing mill consists of two roll stands.

5. The method of claim 4, wherein said given thickness is on the order of 0.040 inch.

6. The method of claim 5, wherein said penultimate pass is to a thickness on the order of 0.060 inch.

7. The method of claim 2, wherein a pair of pinch rolls is located between each of said drums and said mill and stopping said rolling when an extreme end of the hot mill band is positioned at one of said pair of pinch rolls.

8. The method of claim 7, including flattening said trailing end in said pair of pinch rolls.

9. The method of claim 2, wherein said slab was of intermediate thickness.

10. The method of claim 9, wherein said slab was between about three to six inches.

11. The method of claim 2, wherein said given thickness is on the order of 0.0787 inch and said penultimate pass is to a thickness on the order of 0.0925 inch.

12. A method of rolling light gauge hot mill band of a given thickness from a slab product on a hot reversing mill having a coiler furnace and drum upstream and downstream of said mill comprising in sequence:

a. passing said slab product back and forth through said mill to form an intermediate product having a thickness capable of being coiled;

b. coiling said intermediate product on one of said upstream or downstream drums;

c. passing said intermediate product back and forth through said mill between said drums and onto one of said drums at a thickness greater than said given thickness;

d. decoiling said intermediate product and passing it through said mill onto a coiler in a penultimate pass while stopping said hot mill band in said mill so as to leave a trailing end at least some of which has not been further reduced;

e. decoiling said intermediate product and passing it through said mill in a final pass to said given thickness and at a desired finishing temperature; and f. removing said trailing end to form a hot mill band of said given thickness.

13. The method of claim 12, wherein a pair of pinch rolls is located between each of said drums and said mill and stopping said rolling when an extreme end of the hot mill band is positioned at one of said pair of pinch rolls.

14. The method of claim 12, including flattening said trailing end in said pair of pinch rolls.

15. The method of claim 12, wherein said trailing end represents no more than 2.2% of said hot mill band.

16. The method of claim 12, wherein said slab product was between about three to six inches.

17. The method of claim 12, wherein said given thickness is on the order of 0.0787 inch and said penultimate pass is to a thickness on the order of 0.0925 inch.

18. The method of claim 12, wherein said hot reversing mill consists of two roll stands.

19. The method of claim 18, wherein said given thickness is on the order of 0.040 inch.

20. The method of claim 18, wherein said penultimate pass is to a thickness on the order of 0.060 inch.

* * * * *

UNITED STATES PATENT AND TRADEMARK OFFICE

CERTIFICATE OF CORRECTION

PATENT NO. : 5,647,236

DATED : July 15, 1997

INVENTOR(S) : George W. Tippins

It is certified that error appears in the above-indentified patent and that said Letters Patent is hereby corrected as shown below:

Title page, under [56] References Cited, OTHER PUBLICATIONS, refer to "Sendzimir, Michael G.," "for thin for thin" should read --for thin--.

Column 3 after Table I, refer to "Roughing Mill RMS Production", "733.790" should read --733.970--.

Columns 5-6, Table II, under column heading "Roll Force lb. x 10**6", row CF1: "4.0045" should read --5.0045--.

Columns 5-6, Table II, under column "Horse Power" row "CF2": "61.68." should read --6168.--.

Columns 5-6, Table III, column heading "Torque lt-ft" should read --Torque lb-ft--.

Columns 7-8, Table IV, under column "Gauge in.", next-to-last row, ".0270" should read --.0470--.

Columns 7-8, Table IV, under column "Draft in.", eighth figure, "0.53" should read --.053--.

Columns 7-8, Table IV, under column "Roll Force", Row 3: "3.1090" should read --3.0190--.

Columns 7-8, Table IV, under column "Roll Force", Row 8: "3.697" should read --3.6907--.

Columns 7-8, Table IV, last Note under Table: "Flnal" should read --Final--.

-continued-

UNITED STATES PATENT AND TRADEMARK OFFICE

CERTIFICATE OF CORRECTION

PATENT NO. : 5,647,236

DATED : July 15, 1997

INVENTOR(S) : George W. Tippins

It is certified that error appears in the above-indentified patent and that said Letters Patent is hereby corrected as shown below:

Column 9, Table VI, Note under **: "1580°F finishing" should read --1580°F. is finishing--.

Signed and Sealed this

Eleventh Day of November, 1997

*Attest:*

Bruce Lehman

BRUCE LEHMAN

*Attesting Officer*

*Commissioner of Patents and Trademarks*